US006298702B1

(12) United States Patent
Korte

(10) Patent No.: US 6,298,702 B1
(45) Date of Patent: Oct. 9, 2001

(54) METHOD FOR MAKING SEAMLESS WHEEL RIMS

(75) Inventor: Helmut Korte, Malibu, CA (US)

(73) Assignee: Advanced Metalforming Technologies, Inc., Los Angeles, CA (US)

( * ) Notice: Subject to any disclaimer, the term of this patent is extended or adjusted under 35 U.S.C. 154(b) by 0 days.

(21) Appl. No.: 09/439,100

(22) Filed: Nov. 12, 1999

(51) Int. Cl.[7] ..... B21D 22/14
(52) U.S. Cl. ..... 72/85; 72/91
(58) Field of Search ..... 29/894.354; 72/82, 72/83, 84, 85, 91

(56) References Cited

U.S. PATENT DOCUMENTS 491,188 * 2/1893 Polte ..... 72/85
1,809,605 * 6/1931 Sauzedde ..... 29/894.354
2,398,438 * 4/1946 Metzner ..... 72/85

FOREIGN PATENT DOCUMENTS 1 287 549 * 1/1969 (DE) ..... 72/85
245 137 * 4/1987 (DE) ..... 72/82
60-102240 * 6/1985 (JP) ..... 72/82

* cited by examiner

*Primary Examiner*—Lowell A. Larson
(74) *Attorney, Agent, or Firm*—Sheldon & Mak; Denton L. Anderson

(57) ABSTRACT

A method for forming seamless tubular workpieces, such as vehicular wheel rim components. In the method, a flat circular blank having a central aperture is expanded into the interior of a hollow mandrel using a mushroom-shaped spinning roller. In this expansion operation, the blank is caused to take on a tubular shape having an exterior contour which conforms to the interior contour of the hollow mandrel.

18 Claims, 5 Drawing Sheets

METHOD FOR MAKING SEAMLESS WHEEL RIMS

FIELD OF THE INVENTION

This invention relates generally to methods for forming metal workpieces and, more particularly, to methods for forming seamless tubular workpieces, such as wheel rim components.

BACKGROUND OF THE INVENTION

Seamless aluminum wheel rims for automobiles and other vehicles have become very popular. Such seamless wheel rims are generally held to be both structurally and aesthetically superior to conventional wheel rims.

Unfortunately, previously-known methods of making seamless wheel rims are unduly expensive, because such seamless wheel rims are either extruded or machined using external mandrels which produce large amounts of scrap metal waste.

Accordingly, there is a need for an improved method of forming seamless wheel rims without the problems associated with prior art processes.

SUMMARY

The invention satisfies this need. The invention is a method and an apparatus for forming a hollow annular work piece, such as a wheel rim component. The method comprises the steps of (a) providing a hollow mandrel with a forward end, a rearward end, a longitudinal axis and an internal surface typography, the forward end having a substantially circular cross-section with an internal diameter, the internal surface typography being the reverse of the desired typography, (b) providing a disc-shaped metallic blank having a centralized aperture, the centralized aperture having a center, (c) securing the blank to the forward end of the mandrel such that the center of the centralized aperture is aligned with the longitudinal axis of the mandrel, and (d) rotating the mandrel about the longitudinal axis of the mandrel while pressing the blank against the interior surface of the mandrel with a spinning roller, the spinning roller having a smooth rounded surface, the pressing of the blank against the interior surface of the mandrel being continued until the blank takes on a hollow annular shape having an external surface with the desired typography.

DRAWINGS

These features, aspects and advantages of the present invention will become better understood with regard to the following description, appended claims and accompanying figures where:

DETAILED DESCRIPTION

Figure 2:
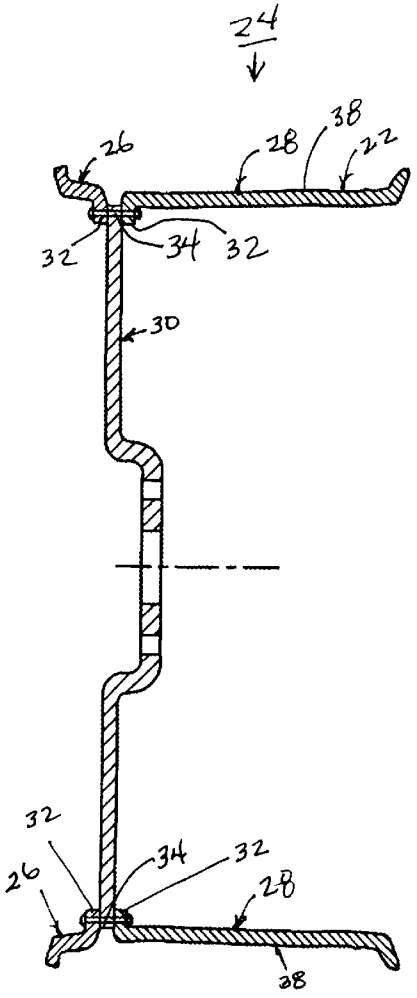
FIG. 2 is a cross-sectional side view of the wheel rim illustrated in FIG. 1 taken along line 2—2.

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a method and apparatus for forming a hollow annular workpiece 20. The apparatus 10 comprises a hollow mandrel 12, a mandrel retaining assembly 14, a spinning roller 16 and a spinning roller carriage 18.

Figure 1:
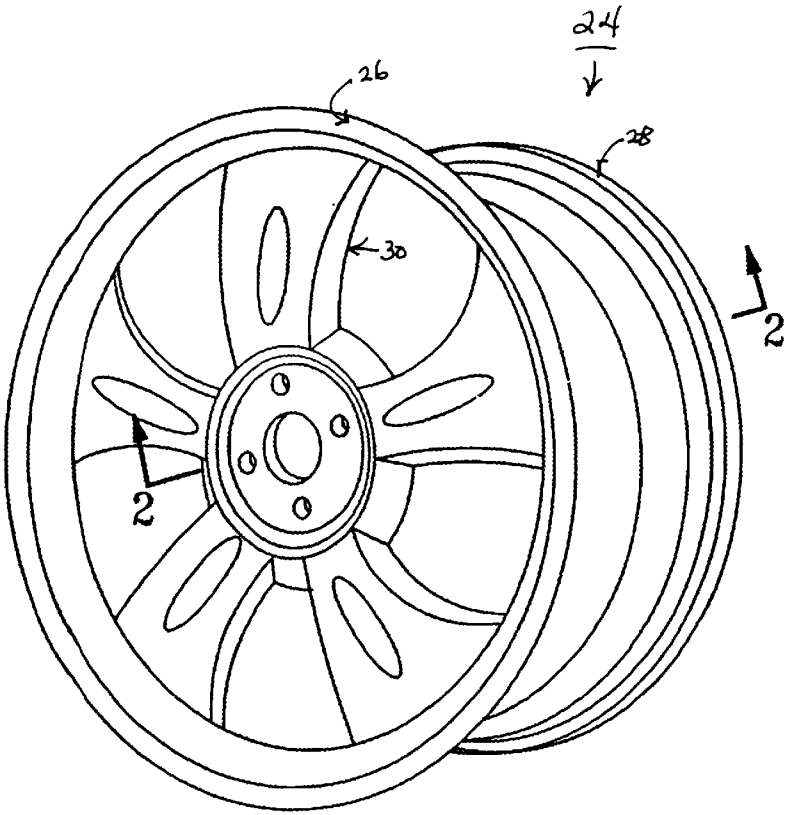
FIG. 1 is prospective of a wheel rim which can be constructed by the invention.

The invention can be used to manufacture hollow annular workpieces 20, such as wheel rim components 22. A typical wheel rim 24 is illustrated in FIGS. 1 and 2. The wheel rim 24 illustrated in FIGS. 1 and 2 is commonly termed a "three-piece" wheel rim because it comprises a forward moiety 26, a rearward moiety 28 and a center plate 30. Both the forward moiety 26 and the rearward moiety 28 have end flanges 32 to facilitate their connection to each other and to the center plate 30. The three pieces are typically fastened together with bolts 34 (as illustrated in FIG. 2) or are welded together to form a completed wheel rim 24. The apparatus of the invention 10 can be used to manufacture the forward moiety 26 of the wheel rim 24 and the rearward moiety 28 of the wheel rim 24. In another embodiment of the invention, the apparatus of the invention 10 can be used to manufacture one-piece integral combinations 36 of the forward moiety 26 and the rearward moiety 28. Such integral combinations 36 can be assembled with a center plate 30, usually by welding. Such combination 36 is commonly termed a "two-piece" wheel rim. The forward moiety 26, the rearward moiety 28 and the integral combination 36 of the forward and rearward moieties 26 and 28 are referred to herein as "wheel rim components 22." All such wheel rim components 22 have an external surface 38 with a desired typography.

Figure 6A:
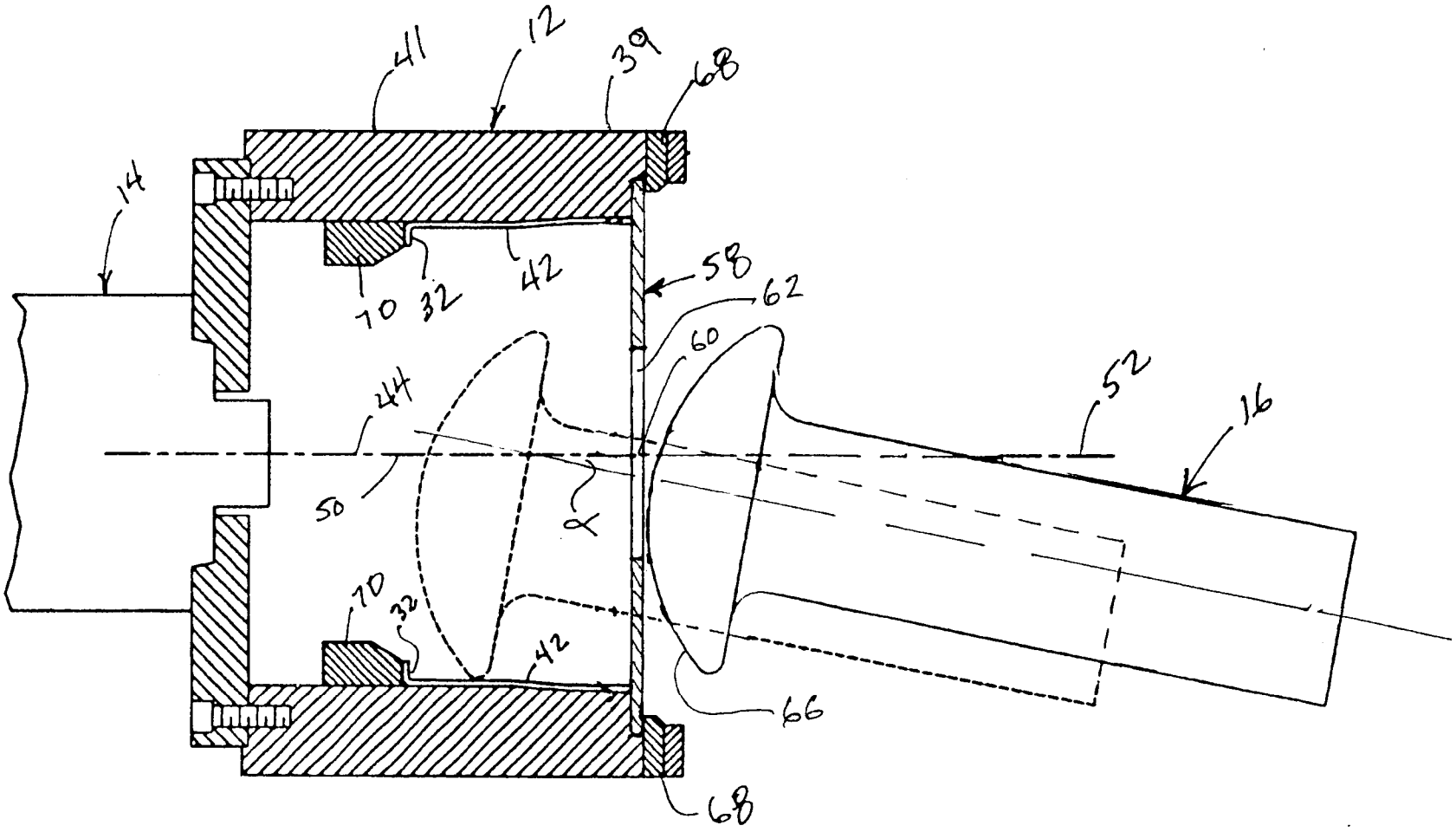
FIG. 6A is a top view detail, in partial cross-section, of a hollow mandrel useable in the invention shown in the fabrication of a workpiece.
Figure 6B:
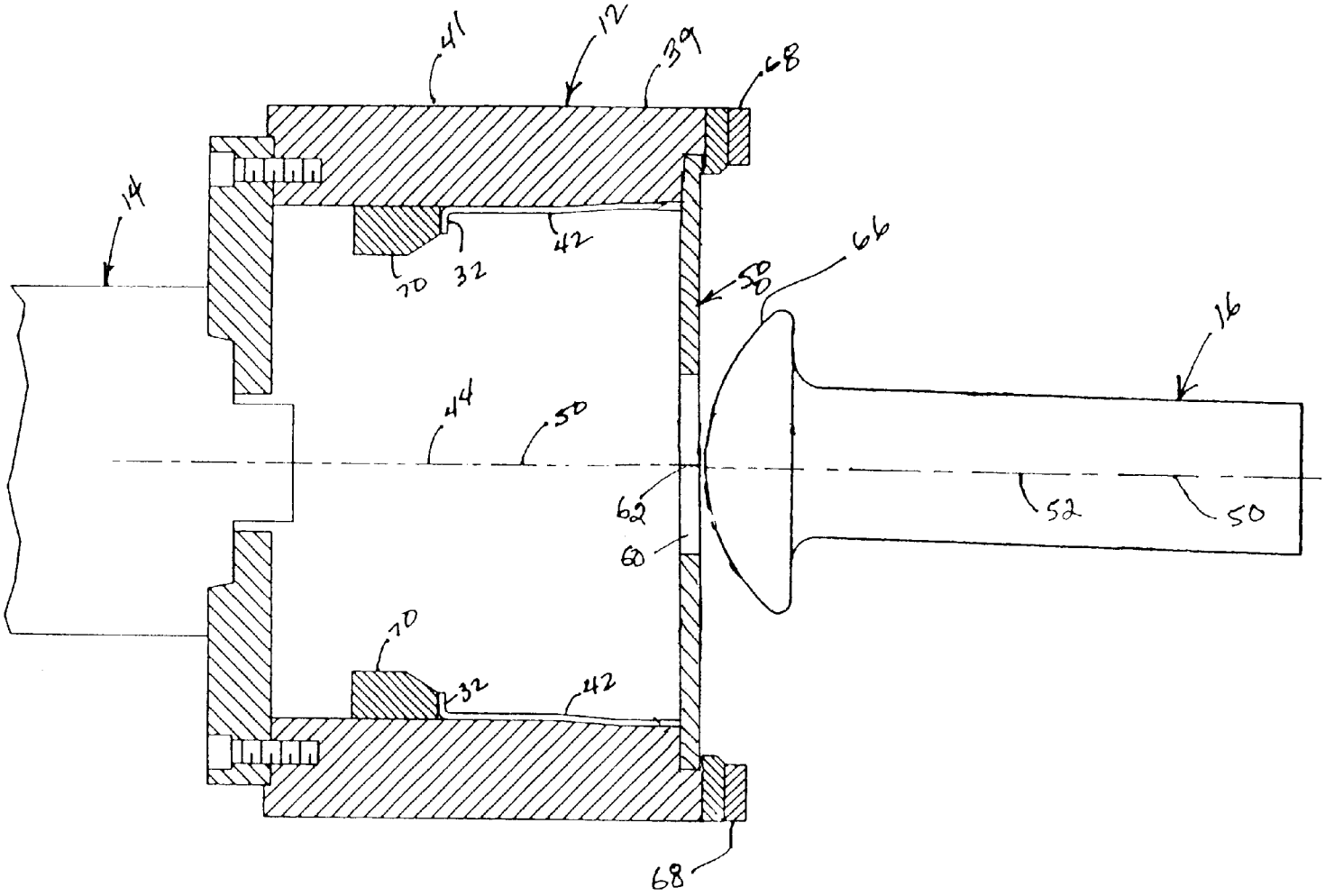
FIG. 6B is a side view of the hollow mandrel illustrated in FIG. 6A.
Figure 7:
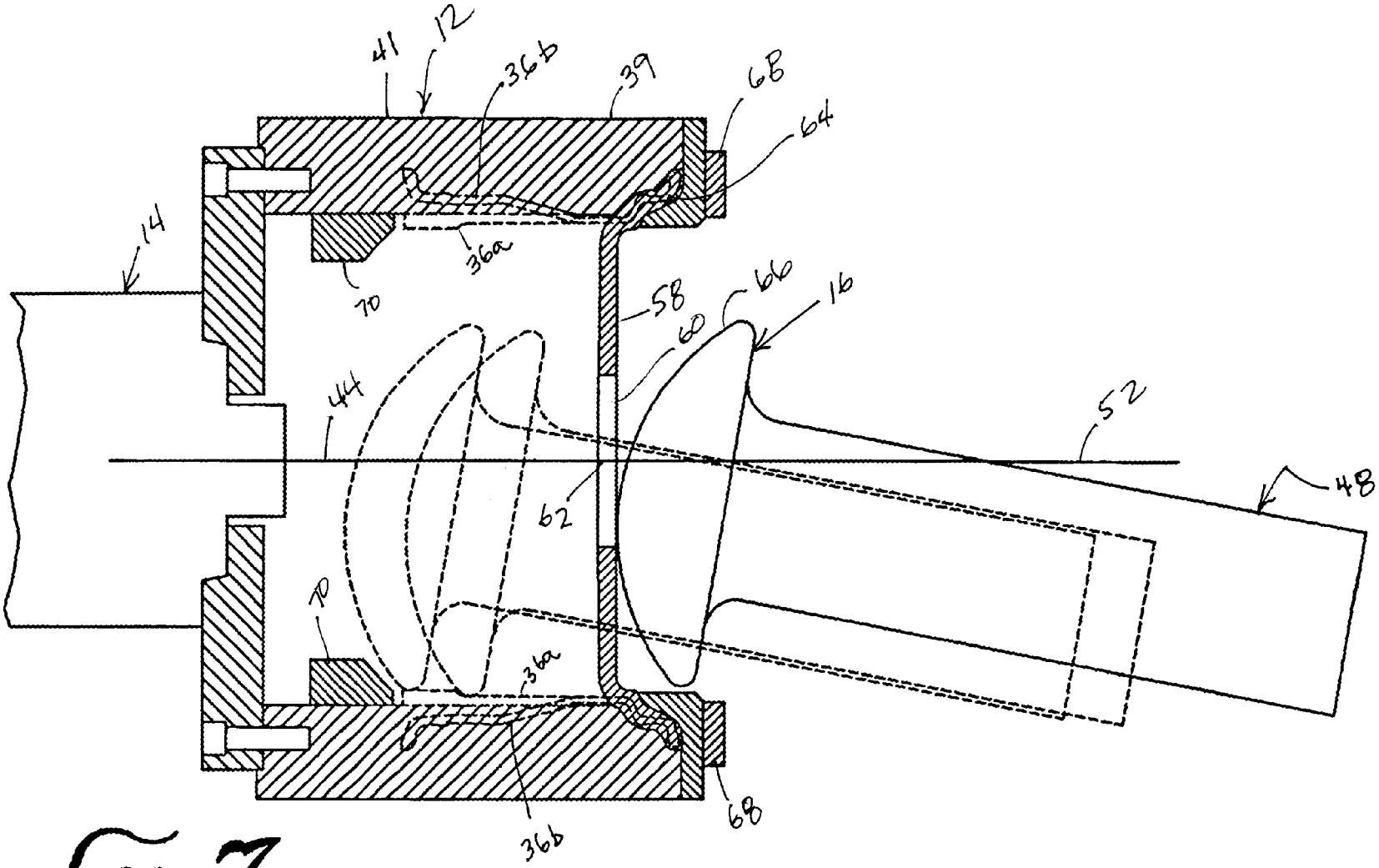
FIG. 7 is a top view detail, in partial cross-section, of a hollow mandrel useable in the invention shown in the fabrication of a second workpiece.

The mandrel 12 is most conveniently seen in FIGS. 6 and 7. The mandrel 12 comprises a forward portion 39 having a forward end 40, a rearward portion 41 having a rearward end 42 and a longitudinal axis 44. The forward end 40 has a substantially circular cross-section with a forward end internal diameter between about 10 inches and about 24 inches. The rearward portion 41 is also substantially circular with a rearward portion internal diameter. In a typical embodiment, the mandrel 12 is made from steel.

The internal surface 46 of the mandrel 12 has an internal surface typography which is the reverse of the desired typography of the workpiece 20. In some embodiments, the internal surface typography of the mandrel 12 defines a smooth right circular cylinder. In other embodiments, the internal surface typography can be a non-smooth, non-cylindrical surface, termed herein as a "contoured surface."

The mandrel retaining assembly 14 allows the mandrel 12 to be rotated at a rate of rotation which is typically between about 100 rpm and about 800 rpm, most typically between 400 rpm and about 500 rpm.

The spinning roller 16 is disposed proximate to the forward end 40 of the mandrel 12 on a spinning roller shaft 48. The spinning roller 16 is rotatable by the spinning roller shaft 48 at rates of rotation typically between about 50 rpm and about 1000 rpm, most typically between about 300 rpm and about 500 rpm. The spinning roller shaft 48, in turn, is retained on the spinning roller carriage 18. The spinning roller carriage 18 maintains the spinning roller shaft 48 in a spinning roller plane 50 which contains the linear extension 52 of the longitudinal axis 44 of the mandrel 12. Typically, the spinning roller plane 50 is a substantially horizontal plane, although it can also be a vertical plane or a plane disposed neither horizontally or vertically.

The spinning roller carriage 18 is moveable between a forward most position, wherein the spinning roller 16 is disposed within the hollow mandrel 12, and a rearward most position wherein the spinning roller 16 is disposed external of the mandrel 12. The spinning roller carriage 18 is also capable of moving the spinning roller shaft 48 laterally within the spinning roller plane 50. Preferably, the spinning roller carriage 18 is capable of "canting" the spinning roller shaft 48 with respect to the linear extension 52 of the longitudinal axis 44 of the mandrel 12. In a typical embodiment, the spinning roller shaft 48 can be canted to angles A between about −5° and about +30° with respect to the linear extension 52 of the longitudinal axis 44 of the mandrel 12.

In the embodiment illustrated in the drawings, the spinning roller carriage 48 includes a pair of longitudinal opposed track members 54 for allowing the movement of the spinning roller 16 between the forward most position and the rearward most position. The spinning roller carriage 48 further comprises a pair of lateral track members 56 for allowing movement of the spinning roller shaft 48 in opposed lateral directions.

Figure 5:
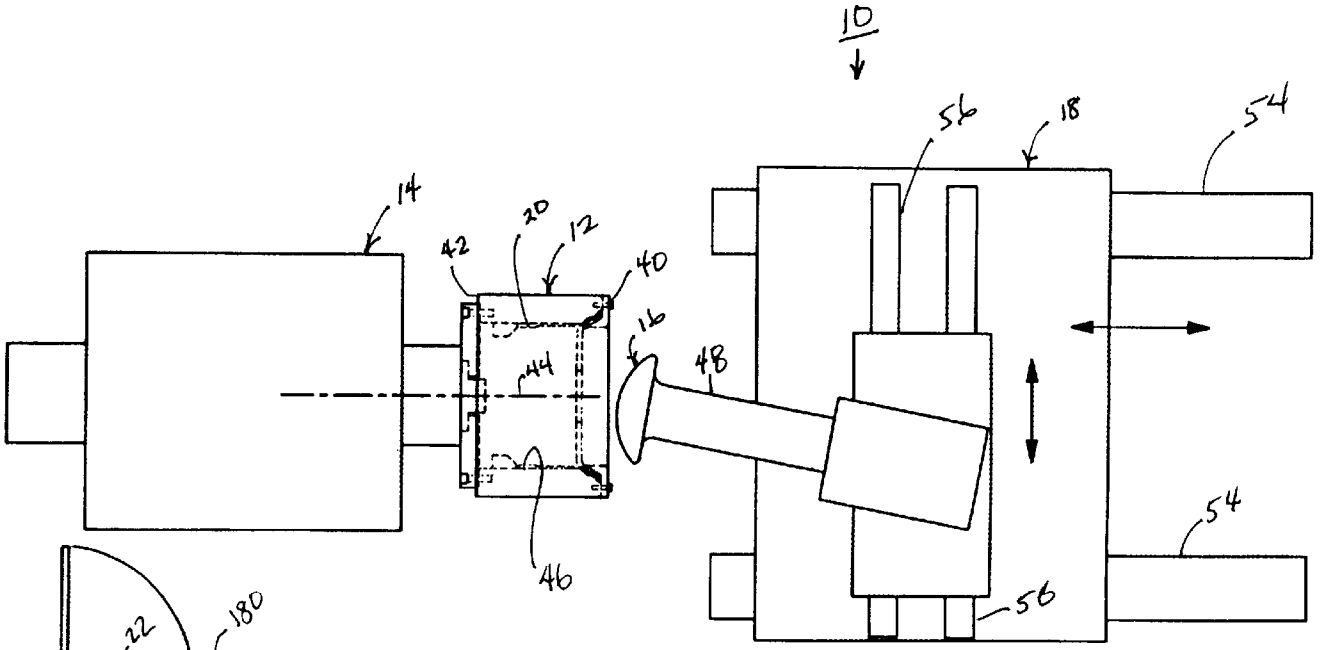
FIG. 5 is a top view of an apparatus having features of the invention.
Figure 4:
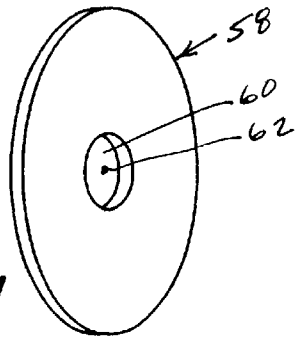
FIG. 4 is a prospective view of a blank useable in the invention.

The apparatus 10 is capable of spin forming disk-shaped metallic blanks into the completed annular workpieces 20. FIG. 4 illustrates a typical disk-shaped metallic blank 58. The blank 58 has a centralized aperture 60 with a center 62. The blank 58 can be substantially flat across its entire diameter (as illustrated in FIG. 4) or it can have a non-flat perimeter 64, such as illustrated in FIGS. 5, 6 and 7. Such non-flat perimeters 64 are typically provided in a preliminary machining or forging operation.

The blank 58 can have a substantially uniform thickness, but this is not necessary. In some applications, the blanks 58 are non-uniform in thickness. In the formation of wheel rim components 22, the thickness of the blank 58 is typically between about 0.2 inch and about 1.5 inches.

The blank 58 is typically made from a material comprising aluminum or aluminum alloy. In many applications, the blank 58 will consist essentially of aluminum or aluminum alloy. The apparatus 10 and the method of the invention can also be used with other metals. The centralized aperture 60 is typically circular and has a diameter between about 4 inches and about 16 inches. In most applications, the optimum diameter of the centralized aperture 60 will depend upon the thickness and the ductility of the blank 58 and upon the thickness of the workpiece 20 to be formed from the blank 58.

Blanks 58 made from aluminums or other materials having high elongation characteristics are often preferred in the invention because such materials are less likely to crack during fabrication.

The blank 58 can be conveniently manufactured from inexpensive cast material, such as 7-inch diameter billets of cast material. Such cast material can then be machined into a substantially planar shape using, for example, a rotary forge.

The spinning roller 16 has a smooth, rounded surface 66, such as the "mushroom-shaped" spinning rollers 16 illustrated in the drawings.

In the method of the invention, hollow annular workpieces 20 having an external surface 38 with a desired typography are formed in the following steps. A disk-shaped metallic blank 58 is secured to the forward end 40 of the hollow mandrel 12 using a mechanical clamp 68 or equivalent device. The center 62 of the centralized aperture 60 of the blank 58 is aligned with the longitudinal axis 44 of the mandrel 12. The mandrel 12 is then rotated about the longitudinal axis 44 of the mandrel 12 while the spinning roller 16 (rotating on the spinning roller shaft 48) is slowly pressed against the rotating blank 58. The initial pressure applied to the blank 58 by the spinning roller 16 is made proximate to the centralized aperture 60 of the blank 58. Using the forward/backward and lateral movement of the spinning roller carriage 18, the spinning roller 16 can be moved forward and rearward as well as left and right within the spinning roller plane 50. Also, the spinning roller shaft 48 can be canted with respect to the linear extension 52 of the longitudinal axis 44 of the mandrel 12, so that the pressure of the spinning roller 16 on the blank 58 can be applied obliquely.

The entire operation can, in many instances, be carried out in a single "pass." In other operations, two or more passes are used.

The operation is continued until the blank 58 is formed into a hollow annular workpiece 20 having an external surface 38 with the desired typography.

Typically, the blank is at ambient temperature during the operation. With certain metals and with certain thicknesses of metals, the operation is preferably carried out after the blank has been preheated up to about 650° F.

FIGS. 6A and 6B illustrate an embodiment of the invention 10 wherein a rearward moiety 28 of a wheel rim 24 is formed. The spinning roller 16 is pressed against the blank 58 until the centralized apertured 60 is expanded to substantially the same diameter as the rearward portion internal diameter and the blank 58 is expanded into an annular tubular configuration having a contoured external surface 38 which is the reverse of the internal contoured typography 46 of the mandrel 12. In the embodiment illustrated in FIGS. 6A and 6B, an end flange 32 is provided on the rearward moiety 28 by pressing the blank 58 against an annular stop ring 70 disposed within the mandrel 12.

FIG. 7 illustrates another embodiment of the invention. In this embodiment, an integral wheel rim combination 36 is formed. In a most typical embodiment, the internal typography 46 of the mandrel 12 defines a smooth, right circular cylinder. The spinning roller 16 presses the blank 58 against the internal typography 46 of the mandrel 12 until the blank 58 is expanded into an annular tubular configuration having a smooth exterior typography 38 in the shape of a right circular cylinder. Thereafter, the completed workpiece 20 is removed from the mandrel 12 and is machined in a separate post-invention step into the final configuration of the integral wheel rim combination 36, typically by spin forming or press forming.

In an alternative embodiment, the integral wheel rim combination 36 can be wholly formed within the mandrel 12. In this embodiment, the mandrel 12 must be separable along edges parallel with the longitudinal axis 44 so that the completed integral wheel rim combination 36 can be removed from the mandrel 12. In one such embodiment, the mandrel 12 is separable in "clam-shell" fashion. In another embodiment, the mandrel 12 is separable in "chuck-like" fashion.

Figure 3:
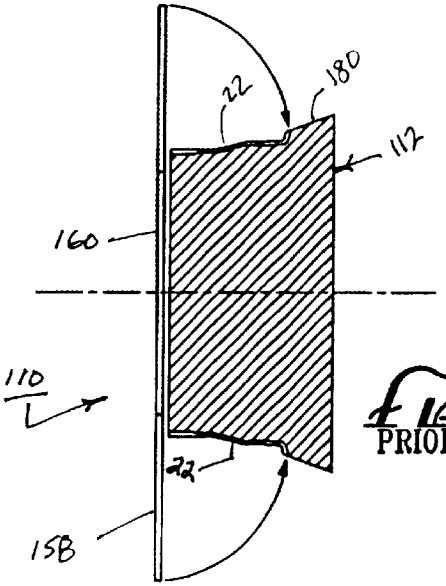
Fig. 3 PRIOR ART
FIG. 3 is a cross-sectional side view illustrating a prior art process for making tubular work pieces using a solid mandrel.

The invention 10 can be used to manufacture seamless wheel rims 24 in an efficient and far less expensive manner than methods and apparatuses of the prior art. The invention 10 is contrasted with methods and apparatuses 110 of the prior art for manufacturing seamless wheel rims 24 as illustrated in FIG. 3. In such prior art methods and apparatuses 110, a substantially flat blank 158 is machined into a wheel rim component 22 by pressing the blank 158 against the outside typography 180 of an external mandrel 112. As can be readily appreciated, the flat blanks 158 used in such prior art methods must be considerable larger in diameter than blanks 58 used in the invention 10. For example, in forming a 17-inch wheel rim 24, a typical blank 58 used in the invention 10 is 19 inches in diameter, whereas a typical blank 158 used in prior art methods 110, such as illustrated in FIG. 3, would be about 22½ inches in diameter. Since the circular blanks 58 and 158 in both cases are most conveniently cut from square sheets, it can be seen that the amount of waste material created in the preparation of a 22½ inch diameter blank 158 is considerably more than that which results from the creation of a 19-inch diameter blank 58. Moreover, in methods of the prior art, the centralized aperture 160 of the blank 158 must be considerably larger than the centralized aperture 60 in blanks 58 used in the invention 10. Accordingly, the method of the invention 10 entails a second considerable savings stemming from less wasted scrap metal from the formation of the centralized aperture 60 of the blank 58.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A method for forming a hollow annular wheel rim component having an external surface with a desired typography, the method comprising the steps of:

(a) providing a hollow mandrel having a forward portion with a forward end, a rearward portion with a rearward end, a longitudinal axis and an internal surface typography, the forward end having a substantially circular cross-section with a forward end internal diameter, the rearward portion having a substantially circular cross-section with a rearward portion internal diameter, the internal surface typography being the reverse of the desired typography;

(b) providing a disc-shaped metallic blank having a centralized aperture, the centralized aperture having a center;

(c) securing the blank to the forward end of the mandrel such that the center of the centralized aperture is aligned with the longitudinal axis of the mandrel; and (d) rotating the mandrel about the longitudinal axis of the mandrel while pressing the blank against the interior surface of the mandrel with a spinning roller, the spinning roller having a smooth rounded surface, the pressing of the blank against the interior surface of the mandrel being continued until the centralized aperture is expanded to a diameter substantially the same as the rearward portion internal diameter and the blank takes on a hollow annular shape having an external surface with the desired typography.

2. The method of claim 1 wherein the forward end of the mandrel has an internal diameter between about 10 inches and about 24 inches.

3. The method of claim 1 wherein the internal surface typography of the mandrel defines a smooth right circular cylinder.

4. The method of claim 1 wherein the internal surface typography of the mandrel is a textured surface.

5. The method of claim 1 wherein the metallic blank comprises aluminum or aluminum alloy.

6. The method of claim 1 wherein the metallic blank has a substantially uniform thickness of between about 0.2 inches and about 1.5 inches.

7. The method of claim 1 wherein the metallic blank has a non-flat perimeter.

8. The method of claim 1 wherein the metallic blank is substantially flat.

9. The method of claim 1 wherein the metallic blank is substantially circular with a diameter of between about 14 inches and about 28 inches.

10. The method of claim 1 wherein the centralized aperture is circular with a diameter of between about 4 inches and about 16 inches.

11. The method of claim 1 wherein the mandrel is rotated at a rate between about 100 rpm and 800 rpm.

12. The method of claim 1 wherein the spinning roller is rotated at a rate between about 50 rpm and about 1000 rpm.

13. The method of claim 1 wherein the spinning roller is mushroom-shaped.

14. The method of claim 1 wherein the spinning roller is rotated about an axis of rotation which is non-coaxial with the longitudinal axis of the mandrel.

15. A method for forming a hollow annular wheel rim component having an external surface with a desired typography, the method comprising the steps of:

(a) providing a hollow mandrel having a forward portion with a forward end, a rearward portion with a rearward end, a longitudinal axis and an internal surface typography, the forward end having a substantially circular cross-section with a forward end internal diameter, the rearward portion having a substantially circular cross-section with a rearward portion internal diameter, the internal surface typography being the reverse of the desired typography;

(b) providing a substantially circular disc-shaped metallic blank, the metallic blank having a diameter of between about 14 inches and about 28 inches, a substantially uniform thickness of between about 0.2 inch and about 1.5 inches, and a centralized circular aperture, the centralized aperture having a center;

(c) securing the blank to the forward end of the mandrel such that the center of the centralized aperture is aligned with the longitudinal axis of the mandrel; and (d) rotating the mandrel about the longitudinal axis of the mandrel at a rate of between about 100 rpm and about 800 rpm while pressing the blank against the interior surface of the mandrel with a spinning roller rotating at a rate of between about 50 rpm and about 1000 rpm, the spinning roller having a smooth rounded mushroom-shaped surface with circular cross-sections, the pressing of the blank against the interior surface of the mandrel being continued until the centralized aperture is a diameter substantially the same as the rearward portion internal diameter and the blank takes on a hollow annular shape having an external surface with the desired typography.

16. The method of claim 15 wherein the forward end of the mandrel has an internal diameter between about 10 inches and about 24 inches.

17. The method of claim 15 wherein the metallic blank has a non-flat perimeter.

18. The method of claim 15 wherein the spinning roller is rotated about an axis of rotation which is non-coaxial with the longitudinal axis of the mandrel.

* * * * *